United States Patent [19]

Rüttershoff

[11] 3,945,137

[45] Mar. 23, 1976

[54] BRAKE FOR CUSHIONING PENDULUM MOVEMENTS, ESPECIALLY FOR GRAB BUCKETS OF HYDRAULICALLY OPERABLE EARTH DREDGES

[75] Inventor: Heinz Joachim Rüttershoff, Schwelm, Germany

[73] Assignee: O & K Orenstein & Koppel Aktiengesellschaft, Berlin, Germany

[22] Filed: Nov. 13, 1974

[21] Appl. No.: 523,515

[30] Foreign Application Priority Data

Nov. 14, 1973 Germany ..... 2356760

[52] U.S. Cl. ..... 37/183 R; 188/1 B; 188/77 R; 214/147 G

[51] Int. Cl.[2] ..... E02F 5/06

[58] Field of Search ..... 37/182–188; 294/70, 88, 86 R; 175/238; 188/77 R, 83, 1 B; 214/147 G

[56] References Cited

UNITED STATES PATENTS

| | | | |
|---|---|---|---|
| 2,918,145 | 12/1959 | White | 188/77 R |
| 2,949,979 | 8/1960 | Carroll | 188/77 R |
| 3,493,135 | 2/1970 | Novotny | 214/147 G |
| 3,510,018 | 5/1970 | Mork et al. | 37/183 R X |
| 3,592,503 | 7/1971 | Lundberg | 294/86 R |
| 3,651,966 | 3/1972 | Willett | 214/147 G |
| 3,666,057 | 5/1972 | Leifer et al. | 188/1 B |

*Primary Examiner*—E. H. Eickholt
*Attorney, Agent, or Firm*—Walter Becker

[57] ABSTRACT

A pendulum brake for cushioning pendulum movements, especially for grab buckets of hydraulically operable earth dredges in which the pendulum brake is arranged at the free end of the shank. A grab bucket holder and a drum are by means of fitting keys non-rotatably connected to a bolt which serves as shaft and is rotatably journaled in bearings at the free end of the shank. The drum cooperates with two clamps provided with brake linings while the clamps embrace the drum and by means of a clamping screw and dish springs exert a pressure upon the drum.

5 Claims, 4 Drawing Figures

BRAKE FOR CUSHIONING PENDULUM MOVEMENTS, ESPECIALLY FOR GRAB BUCKETS OF HYDRAULICALLY OPERABLE EARTH DREDGES

The present invention relates to a pendulum brake for cushioning the pendulum movements of grab buckets of hydraulically operated earth dredges with a mounting at the free end of the shank.

The heretofore known pendulum brakes are arranged in the grab bucket suspension. By means of this type of mounting a pendulum movement of the grab bucket in transverse direction is to be braked. Such pendulum brakes designed as multiple disc brakes are arranged in front of the suspension and work in conformity with the principle of the axial friction increase. Such arrangements frequently impede the working in narrow spaces and due to their shape and arrangement can be employed only for cushioning the pendulum movements in a direction transverse to the carrier vehicle.

It is, therefore, an object of the present invention to provide a pendulum brake, especially for grab buckets, which will obviate the above outlined drawbacks.

It is a further object of this invention to provide a pendulum brake as set forth in the preceding paragrah, in which the pendulum movements of the grab bucket are cushioned and braked in a longitudinal direction with regard to the carrier device so that the working in narrow ditches, shafts, cuts and in the vicinity of fixed walls will be possible without the danger of damaging the tool or the building-up of the respective building site.

These and other objects and advantages of the invention will appear more clearly from the following specification in connection with the accompanying drawings, in which.

The above outlined objects have been realized according to the present invention by mounting a grab bucket holder and a drum nonrotatably by means of fitting keys on a bolt which serves as shaft and which is rotatably journaled in bearings at the free end of the shank while said drum cooperates with two clamps provided with brake linings which clamps extend around the drum and by means of a clamping screw and dish springs exert a predetermined pressure upon the drum.

According to a further development of the invention, the clamps are mounted in pivot points provided at the free ends of links while said links are nonrotatably connected to the shank at a pivot point.

According to a further development of the invention, the drum employed for the braking of the pendulum movement comprises two sections with clamping blocks connected thereto which latter by means of hexagonal screws are clamped around the bolt serving as shaft and said keys.

The advantage of the device according to the invention consists in that it permits a wide dosing or control of the desired braking of the pendulum movement, and furthermore consists in that the device is installed in such a protective manner that also in a very narrow space all operations necessary for carrying out the desired movements can be carried out by the tool in an unimpeded manner.

Figure 1:
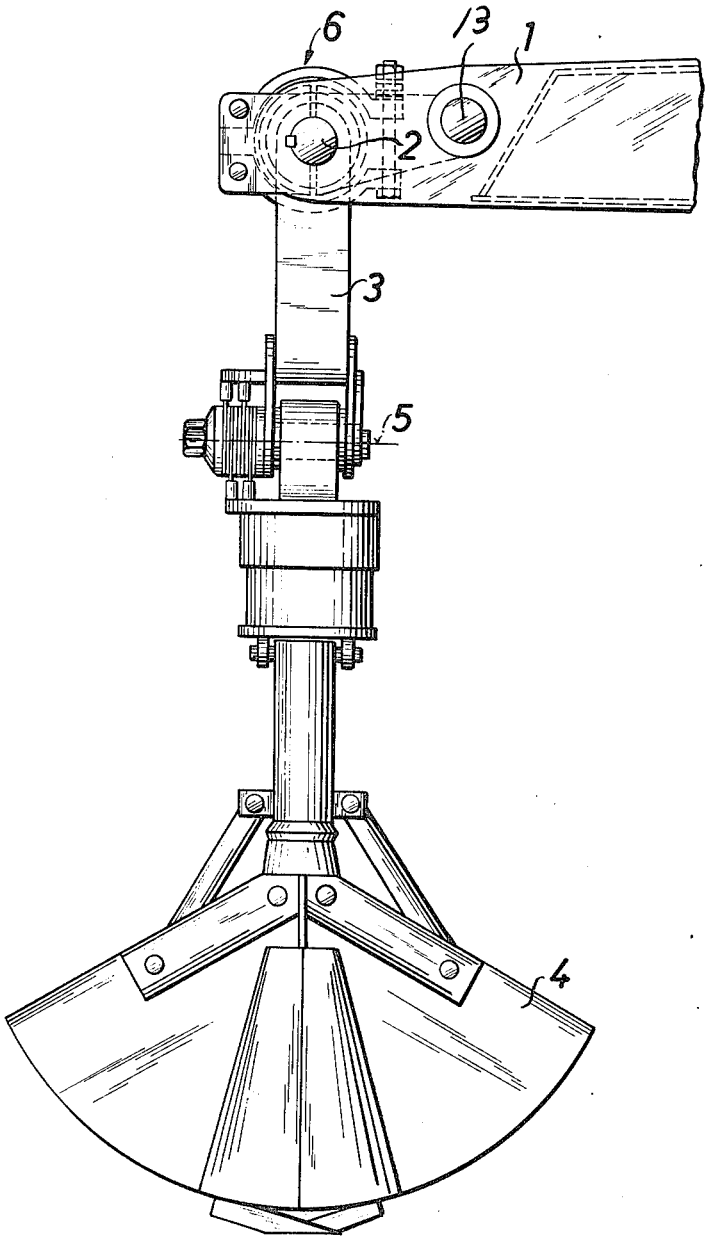
FIG. 1 is a side view of a grab bucket suspended in conformity with the invention at the shank end of an earth dredge.

Referring now to the drawings in detail, at the free end of the shank 1 of a non-illustrated earth dredge, the grab bucket 4 is by means of a grab bucket holder 3 suspended at the pivot point 2 (FIG. 1). The grab bucket 4 is adapted to carry out pendulum movements about the axis 5 in a direction transverse to the driving direction. The pendulum brake 6 is at the pivot point 2 journaled in the forked structure of the shank 1. By means of the pendulum brake 6, the pendulum movements are braked, i.e., cushioned, in the longitudinal direction of the non-illustrated carrier vehicle. The brake 6 is by means of the bolt 7 serving as shaft journaled at the pivot point 2 at the free end of the shank 1. Keys 8 are inserted into the bolt 7 by means of which keys the drum 9 composed of the two drum sections **9*a* and 9*b* and the links 3*a* and 3*b* of the grab bucket holder 3 are secured against turning. By means of the bearing blocks 11*a* and 11*b* and by means of the bolts 12*a* and hexagonal nuts 12 the two drum sections 9*a* and 9*b* are clamped onto the bolt 7. Two links 14 are journaled at the bearing point 13 and have the pivot points 15 and 16 arranged at the free ends of said links 14. The clamps 17 and 18 are journaled at the pivot points 15 and 16 and embrace the two drum sections 9*a* and 9*b* while exerting predetermined pressure against the drum 9.**

Figure 2:
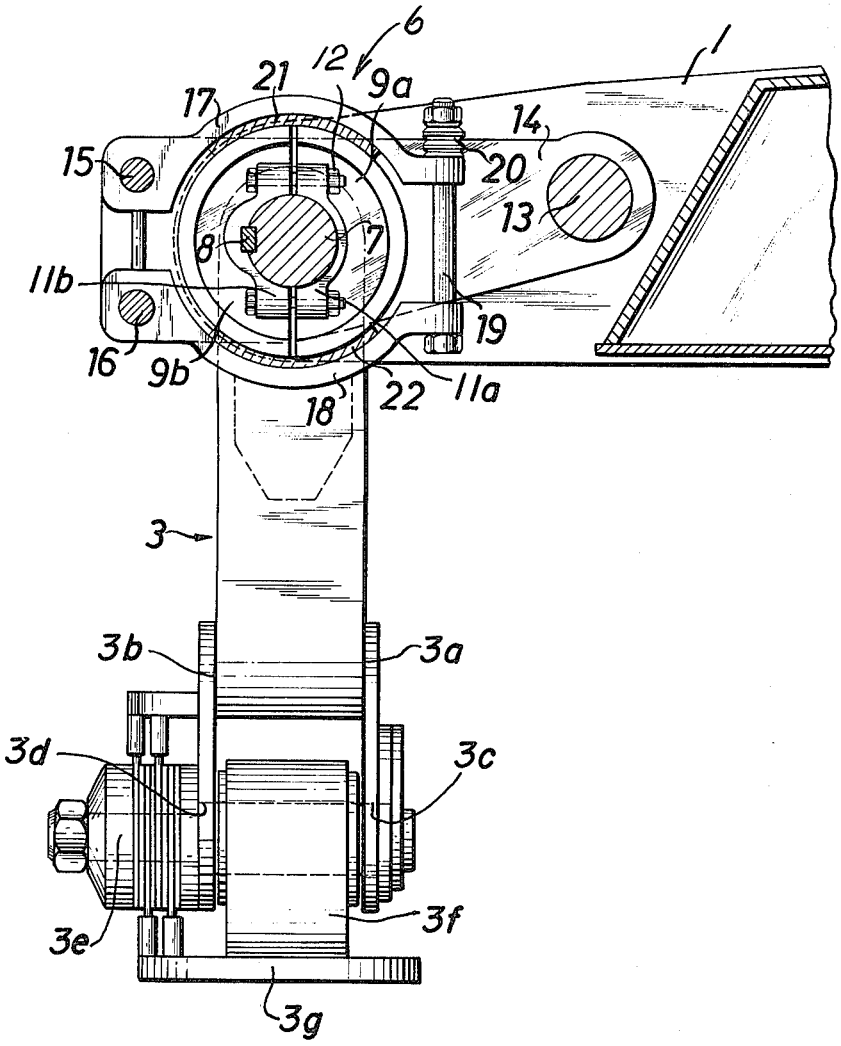
FIG. 2 is a side view of the pendulum brake according to the invention mounted on the end of the shank.

Clamp means 17, 18 include clamping screw means 19 and also nut and sprin means 20 as indicated in FIG. 2. There are plates or straps **3*a* and 3*b* welded onto the grab bucket holder 3 and these are provided at the free ends thereof with bores 3*c* and 3*d*. By means of the bolt 3*e*, the retaining or holding means 3*f* are rotatably journalled on which the plate 3*g* is fastened which serves for receiving the gripper, grasping or grab bucket 4.**

Figure 3:
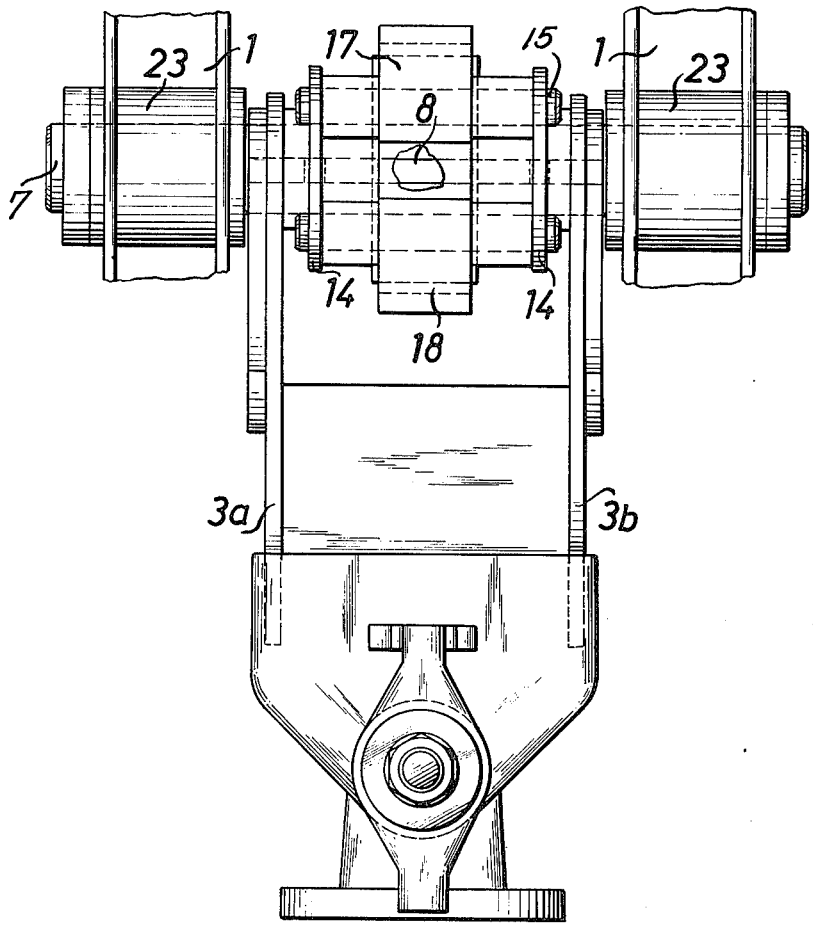
FIG. 3 is a front view of the pendulum brake mounted on the shank end.
Figure 4:
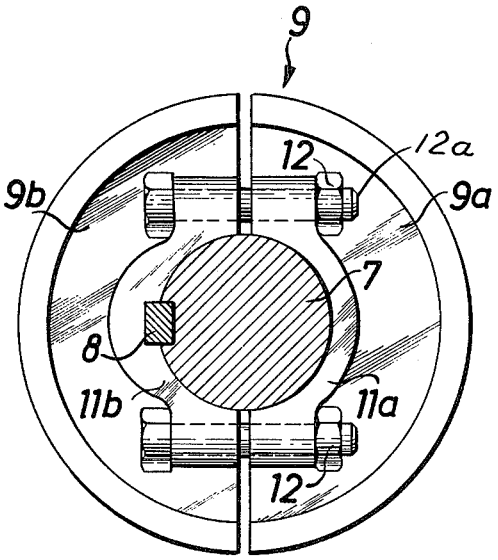
FIG. 4 is a side view of the drum employed in connection with a braking action.

If the brake linings 21 and 22 which are connected to the clamps 17 and 18 are worn, the said pressure may be varied. By unfolding the clamps 17 and 18, an easy exchange of the brake linings 21 and 22 is possible. The mounting of the pendulum brake 6 is effected by means of the bearing areas 23 (FIG. 3) and at the front fork-shaped end of the shank 1.

It is, of course, to be understood that the present invention is, by no means, limited to the specific showing in the drawings but also comprises any modifications within the scope of the appended claims.

What I claim is:

1. In combination with a dredge having shank forming means with a free end thereof, bearing means forming bearing supported by said free end, and a bolt rotatably journaled in said bearing means; a pendulum brake which includes: a grab bucket holder non-rotatably connected to said bolt, brake drum means likewise non-rotatably connected to said bolt, two clamping arms embracing said drum means and provided with brake lining means for frictional engagement with said drum means, and adjustable means associated with said clamping arms and operable to adjust said arms relative to said drum for causing said lining means to exert a desired pressure upon said drum means.

2. An arrangement in combination according to claim 1, which includes key and groove means connecting said grab bucket holder and said drum means to said bolt.

3. An arrangement in combination according to claim 1, in which said clamping arms include clamping screw means extending through said arms, and also includes nut and spring means associated with said screw means.

4. An arrangement in combination according to claim 3, which includes two pivot means arranged at the outer free end of said shank forming means and pivotally supporting one end of each of said two arms, the opposite ends of said two arms having said clamping screw means associated therewith.

5. An arrangement in combination according to claim 2, in which said drum means comprises two separate sections each being provided with two clamping blocks having bores therethrough with the bores of one section being arranged in axial alignment with the respective bores of the other section, and connecting bolts respectively extending through said bores and clamping said drum means onto said bolt.

* * * * *